US005368635A

United States Patent [19]

Yamamoto

[11] Patent Number: 5,368,635

[45] Date of Patent: Nov. 29, 1994

[54] FILTER FOR PARTICULATE MATERIALS IN GASEOUS FLUIDS

[76] Inventor: Yujiro Yamamoto, 1201 Via LaJolla, San Clemente, Calif. 92672

[21] Appl. No.: 230,474

[22] Filed: Apr. 20, 1994

Related U.S. Application Data

[63] Continuation of Ser. No. 17,300, Feb. 12, 1993, abandoned, which is a continuation of Ser. No. 805,006, Dec. 11, 1991, abandoned.

[51] Int. Cl.[5] ..... B03C 3/30

[52] U.S. Cl. ..... 96/17; 96/57; 96/63; 96/67; 96/99

[58] Field of Search ..... 96/17, 63, 57–59, 96/65–70, 99; 55/528, 529, 279; 95/69, 70; 110/216, 217

[56] References Cited

U.S. PATENT DOCUMENTS

| | | | |
|---|---|---|---|
| 895,729 | 8/1908 | Cottrell | 95/73 |
| 2,116,509 | 5/1938 | Cottrell | 204/181.9 |
| 2,579,440 | 12/1951 | Palmer | 96/40 |
| 2,593,377 | 4/1952 | Wintermute | 95/70 |
| 2,634,818 | 4/1953 | Wintermute | 96/36 |
| 3,028,864 | 4/1962 | Minto | 131/333 |
| 3,237,387 | 3/1966 | Haugen et al. | 55/519 X |
| 3,392,509 | 7/1968 | Pelosi, Jr. | 96/66 |
| 3,537,238 | 11/1970 | Dungler | 55/462 X |
| 3,945,813 | 3/1976 | Iinoya et al. | 96/29 |
| 4,205,969 | 6/1980 | Matsumoto | 96/66 |
| 4,244,710 | 1/1981 | Burger | 55/279 X |
| 4,244,712 | 1/1981 | Tongret | 55/279 X |
| 4,313,740 | 2/1982 | Kalishman | 55/527 X |
| 4,313,741 | 2/1982 | Masuda et al. | 96/78 |
| 4,321,066 | 3/1982 | Masuda | 96/40 |
| 4,405,342 | 9/1983 | Bergman | 55/354 X |
| 4,541,847 | 9/1985 | Oie et al. | 55/279 X |
| 4,549,887 | 10/1985 | Joannou | 55/493 X |
| 4,581,046 | 4/1986 | Bergman | 55/484 X |
| 4,623,365 | 11/1986 | Bergman | 55/498 X |
| 4,654,054 | 3/1987 | Snaddon et al. | 96/68 |
| 4,662,903 | 5/1987 | Yanagawa | 96/59 |
| 4,702,752 | 10/1987 | Yanagawa | 55/529 X |
| 4,737,169 | 4/1988 | Bossard | 96/58 |
| 4,759,778 | 7/1988 | Conrad | 96/59 |
| 4,938,786 | 7/1990 | Tonomoto | 55/528 X |
| 4,978,372 | 12/1990 | Pick | 96/67 |
| 5,024,681 | 6/1991 | Chang | 110/217 X |
| 5,108,470 | 4/1992 | Pick | 96/58 |

OTHER PUBLICATIONS

Kanagawa Industrial Tech Development, Japanese Newspaper, Oct., 1989.

Nikkei Mechanical Japanese Publication, p. 81, Oct. 1989.

*Primary Examiner*—Richard L. Chiesa

*Attorney, Agent, or Firm*—Walter A. Hackler

[57] ABSTRACT

A non-ionizing, clog-resistant filter for extracting fine particulate contaminants such as smoke from a gaseous fluid stream such as air uses interaction between Van der Waals forces and a non-ionizing electrostatic field to efficiently capture the contaminant particles in a filter material whose pores are many times larger than the diameter of the particles to be captured. The filter material is physically so configured to further enhance that interaction, and is disposed between at least a pair of electrodes of opposite polarity. The material may be spaced from the electrodes, but preferably touches one of them. The particles are trapped deeply into the thickness of the filter material and leave ample room for continued air flow. The electrostatic voltage is preferably between 3 and 9 kV and is largely independent or electrode spacing. The configuration of the filter material is such that the flow velocity through the material is less than 0.1 m/sec, preferably on the order of 0.03 m/sec.

21 Claims, 4 Drawing Sheets

FILTER FOR PARTICULATE MATERIALS IN GASEOUS FLUIDS

This is a continuation of copending application Ser. No. 08,017,300 filed on Feb. 12, 1993, now abandoned, which is a continuation, of application Ser. No. 07,805,006, filed Dec. 11, 1991 now abandoned.

FIELD OF THE INVENTION

This invention relates to filters for removing small particulate materials from a gaseous fluid such as air, and more specifically to an electrostatic filter relying principally on Van der Waals forces to entrap the particulate materials.

BACKGROUND OF THE INVENTION

Many types of electrostatic filters have been proposed for removing small particulate materials such as dust, smoke and the like from gases such as air or the exhaust gases of vehicles or industrial processes. Typically, such filters rely in one way or another on the ionization of the particulate material by friction or by a high-voltage electric field, so that they may be trapped and held by electrostatic forces. A common disadvantage of ionizing electrostatic filters is that they operate at sufficiently high voltages to require expensive insulation and safety precautions as well as substantial power and that they produce ozone which constitutes a health hazard.

Non-ionizing electrostatic filters have also been proposed in the past, but their use tends to be limited to special situations, such as the capture of partially conductive soot particles from diesel exhaust.

Mechanical filters (including high-efficiency particulate air (HEPA) and ultra-low penetration air (ULPA) filters) not using electric fields are also common, but they are basically unable to capture particles smaller than their pore size, and they are also subject to rather rapid clogging by captured particles. The clogging takes place mostly on the inflow surface of the filter, and the thickness of the filter material for holding particles is not utilized.

SUMMARY OF THE INVENTION

The present invention provides a simple, highly-effective energy-saving electrostatic particle filter which operates at substantially lower voltages than conventional electrostatic filters, and uses an interaction between natural Van der Waals forces and a non-ionizing electrical field to trap air-borne particulates in an electrically enhanced filter material. This arrangement makes it possible to trap particles of widely varying sizes more efficiently and with less chance of clogging, and without the formation of ozone.

Van der Waals forces are molecular electrostatic fields which are inherently associated with foreign particles suspended in gases such as air. A common manifestation of these forces is the fact that dust is attracted to plastic or other surfaces. Once the particles make contact with the surfaces, this force makes the particles cling to the surface until mechanically removed because the Van der Waals force is proportional to $1/a^6$, where a is the effective distance of the particle from the surface. Thus this force provides a strong bond once contact is established. At any significant distance from the surface, Van der Waals forces are very small forces (defined by Van Nostrand's *Encyclopedia of Science* as interatomic or intermolecular forces of attraction), and they do not come into play in conventional electrostatic filters because the flow rate is too high to allow any significant particle capture by Van der Waals forces.

The filter of this invention accomplishes its objectives by using a filter geometry configuration which slows the flow of the air or other gaseous fluid through the filter material to the point where the particles suspended in the fluid can be captured and held in the filter material essentially by Van der Waals forces. Furthermore, while the flow of the air through the filter material longitudinally of the air flow path is slowed down by a specific geometry, the active generally transverse motion of the particles between the electrodes substantially increases the chance that the particles will make contact with the filter material. Consequently, the filter material captures particles much smaller than its pore size; and this minimizes clogging of the filter. By the same token, as the pore size is much larger than the particles, the thickness of the filter material can be substantially increased in comparison with filter materials in conventional filters. The increased thickness of the filter material thus made possible further contributes to much more effective filtration. In the inventive filter, the electrostatic field is used only to enhance the action of the Van der Waals force, and to impart to the particles the generally transverse motion which facilitates their capture.

Within limits, the operation of the filter of this invention is dependent only upon the absolute voltage difference across the filter material, not upon the volts/cm field strength of conventional electrostatic filters. Consequently, the thickness of the filter material can be varied to accommodate different environments without changing the electrical components.

In accordance with another aspect of the invention, the action of the Van der Waals forces can be substantially enhanced by causing one of the electrodes to touch the filter material and the other electrode to have an air gap between it and the filter material, or by interweaving or embedding conductive fibers in the filter material. The embedded conductive fibers can consist of chopped microscopic substances (both isolated or non-isolated) which create a vast number of air gaps between the tips of conductive fibers that produce microscopic but strong electric fields in the air gaps and throughout the filter material. However, although materials of this type are generally designed for applications involving the release of static electricity by internal arcing between the fibers of the material, the voltages involved in the invention are too low to cause arcing. This results in further enhancement of the particle attraction by the Van der Waals force, and therefore more efficient filtration.

DESCRIPTION OF THE PREFERRED EMBODIMENT

Figure 1:
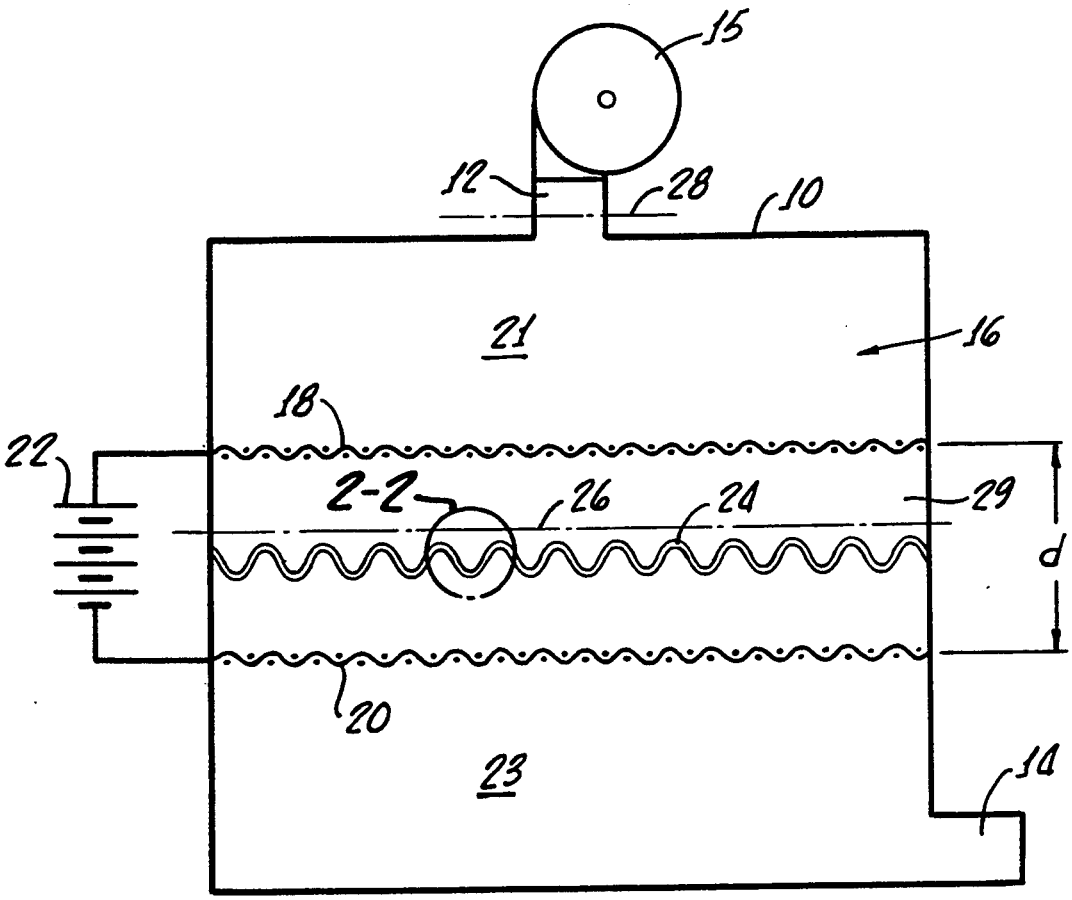
FIG. 1 is a vertical section of a filter constructed in accordance with a preferred embodiment of the invention.

FIG. 1 illustrates a filter constructed in accordance with the invention. A filter housing 10 has an inlet pipe 12 at its top and an outlet pipe 14 at its bottom. A gaseous fluid such as air, contaminated with suspended particulate materials such as dust or smoke, is conveyed through the flow path from inlet pipe 12 to outlet pipe 14 by appropriate impelling means schematically illustrated as a pump 15. The housing 10 encloses a filter chamber 16 in which a pair of apertured electrodes 18, 20 are disposed, transversely to the axis of the chamber 16, between an intake plenum 21 and outlet plenum 23. The electrodes 18, 20 may consist of a metallic mesh or a perforated metallic plate, or they may be carbonized layers of the filter material 24 itself; in either event, the openings in the electrodes 18, 20 are large enough not to significantly affect the air flow through the chamber 16. The electrodes 18, 20 are connected to a direct current voltage source 22. The polarity of the electrodes 18, 20 does not greatly affect the operation of the invention in most instances. However, for optimum capture of the particles, it is preferable to use a layered arrangement in which at least three electrodes of alternating potential alternate with layers of filter material. Also, the polarity for most effective filtration is somewhat dependent upon the nature of the filtered particles, e.g. dielectric particles such as dioctyl phthalate (upstream positive preferable) vs. partially conductive particles such as cigarette smoke (downstream positive preferable). The electrodes 18 and/or 20 may be coated with an insulating material to avoid shorting or extreme reduction of resistance between the electrodes 18, 20 by accumulation of particles in the filter material 24.

Disposed between the electrodes 18, 20 is a porous filter material 24 of a shape discussed in more detail below. The material 24 is preferably a non-hygroscopic material forming a mesh. The filter material 24 may be dielectric or partially conductive, the latter being preferable. Examples of dielectric materials are paper, glass fiber, synthetic fiber, cloth, natural fibers such as cotton (these being better because of their micro-size channels), or materials with a natural electrostatic charge such as 3M's Filtrete or Toray's Tori-Micron (Japan). An example of a suitable conductive material is a metal-impregnated fiber sheet developed by Toray Co. Ltd. and marketed under the name "Soldion paper" by Shiga Shokusan Inc. of Japan. The average pore size of the mesh is preferably about ten to fifty times the average diameter of the particles to be captured, but even particles as small as 1/500 average pore size can be captured to a significant degree if the flow velocity is slow enough. Depending upon the application, the material 24 may be as thick as 25 mm (in a uniform, varying-density, or multi-layered configuration) as compared to typical pleated filter material which is about 0.5 to 1 mm thick. This vastly enhances the capacity of the filter because particle capture occur rather evenly throughout the thickness of the material 24. Stacked pleated filter materials such as commonly used in HEPA, ULPA, and similar filters are preferably used for simplicity in providing the area amplification needed for slowing the fluid flow as described below.

In order for the filter of this invention to effectively utilize the Van der Waals forces associated with the particles to be captured, the flow velocity of the gaseous fluid must be less than about 0.1 m/sec at at least some point of any flow path the fluid can take. For optimum filtration, a flow velocity of 0.03 m/sec is preferred. For example, if the material 24 is folded as in FIG. 2, the surface area of material 24 on the inlet side or the outlet side is $1/\cos\alpha$ times the area of the chamber 16 in the plane 26. Consequently, the flow velocity at plane 26 must not substantially exceed $0.1/\cos\alpha$ m/sec. If $\alpha$ is 45°, the maximum flow velocity at plane 26 is 0.14 m/sec. If the area of the inlet pipe 12 in the plane 28 is, for example, 1/100 the chamber area in plane 26, then the flow velocity in the inlet pipe 12 can be as high as 14 m/sec with $\alpha=45°$. To keep the flow of air as even as possible through the entire surface area of the filter, any sharp bend of the material should be avoided. The preferred surface contour of the filter material is similar to a sinusoidal wave shape, whereby the thickness of the material is even throughout the surface. The electrodes 18, 20 may be shaped to follow the undulations of the filter material surface, as illustrated in FIG. 5*b*.

The slow flow velocity of the particles in the direction of flow merely causes the particles to remain in the filter material 24 long enough to be captured. In a direction generally transverse to the flow direction, however, the electrostatic field imparts to the particles a turbulent motion which greatly enhances the chances, during their passage through the filter material 24, of approaching a filter material fiber sufficiently to be captured by the Van der Waals force. For this reason, it is preferable for the filter material 24 in the inventive filter to be thick (e.g. 2–3 cm.) in the direction of flow, contrary to conventional filters in which most of the particle capture occurs at the material's upstream surface.

In accordance with the invention, the d.c. potential difference between the electrodes 18, 20 should be at least 2 kV but not more than 10 kV, and preferably in the range of 3–9 kV, with the optimum being about 7 kV. The precise voltage selection is dependent upon the particulate material of interest, the porosity of the filter, the type of filter material used, and the velocity of the air stream through the filter.

Above 10 kV, filtration continues to improve slightly. However, that improvement is due to an artificially induced ionization of the particles, which begins to occur in localized areas at about 8 kV. The problem with this is that when the filter itself thus generates ionized particles, some of those particles are entrained by the air stream and attach themselves to walls and ducts downstream of the filter. In those positions, the particles become contaminants with an unpredictable timing of release into the air—an undesirable situation for, e.g., a clean room atmosphere. In summary, too high a voltage wastes energy, and presents a danger of ionization, without significantly improving filter performance; too low a voltage degrades the performance of the filter.

The distance d between the electrodes 18, 20 can vary over a substantial range at any given voltage with very little effect on the capture ability of the material 24. As a practical matter, the distance d is preferably kept in the range of about 5–40 mm for effective filtration. Too small a distance creates a danger of arcing; too large a distance degrades the performance of the filter. The voltage level affects the size of particles that can be captured as well as the depth of their penetration into the filter material 24.

The properties of the filter of this invention are illustrated by the following examples:

EXAMPLE I

A pair of electrodes 18, 20 having a mesh-like structure with apertures with an average opening of about 1 mm square were disposed in a plastic housing 10 with an inside diameter of about 7.5 cm at a distance of about 25 mm from each other. A layer 24 of flat paper fiber material about 2 mm thick having an average pore size of about 10 microns was placed between the electrodes 18, 20 parallel thereto, coextensive therewith, and spaced therefrom, in the chamber 16 formed by housing 10. Air contaminated with cigarette smoke having a particle size range from about 0.01 microns to 1 micron was drawn through the chamber 16 at a rate producing a flow velocity of about 0.01 m/sec through the inlet pipe 12; thus the flow velocity at the electrodes and filter material was much slower. As the voltage of d.c. voltage source 22 was varied (with the positive electrode on the downstream side, although the polarity was found to be essentially immaterial), the following was observed:

When the potential was above 10 kV, the smoke particles failed to penetrate through the electrode 18 and accumulated in the intake plenum 21. A churning cloud of smoke particles formed at this potential above the first electrode 18. It was noted that observable individual particles were moving quite rapidly within this cloud. However, when the potential was incrementally lowered from 9 kV to 3 kV without the filter material 24 in place, the layer of cloud-like smoke particles penetrated into the space 29. As the voltage was lowered, the layer lowered itself closer to the second electrode 20. However, the smoke particles stayed in the space 29 without penetrating through the lower electrode 20. When the experiment was conducted with the filter material 24 in place, essentially all of the smoke particles adhered to the material 24 with the potential ranging between 9 kV and 3 kV. Without the material 24, below 2 kV, there was no longer a layer of cloud observed, and the smoke went through both electrodes and exited to 14 through 23. With a filter material, little or no additional filtering action occurred beyond normal filtering action of the material.

When the voltage is removed or further lowered from the experimented voltage (9 kV–3 kV) to zero volt, adhered particles did not become dislodged from the material 24.

Upon repeating the experiment with thicker material 24 up to 20 mm, it was found that the thicker material provides better filtration by increasing the probability that the particles will adhere to the surface of the filter material.

As the air velocity was increased beyond 0.1 m/sec, the air flow force pushed the particles through the first electrode 18, filter material 24, and second electrode 20; thus the above phenomenon was not readily observed and filtration was very poor.

EXAMPLE II

In the apparatus of Example I, the spacing between electrodes 18, 20 was increased to about 50 mm. The same phenomena as in Example I were observed at the same voltages.

Figure 3:
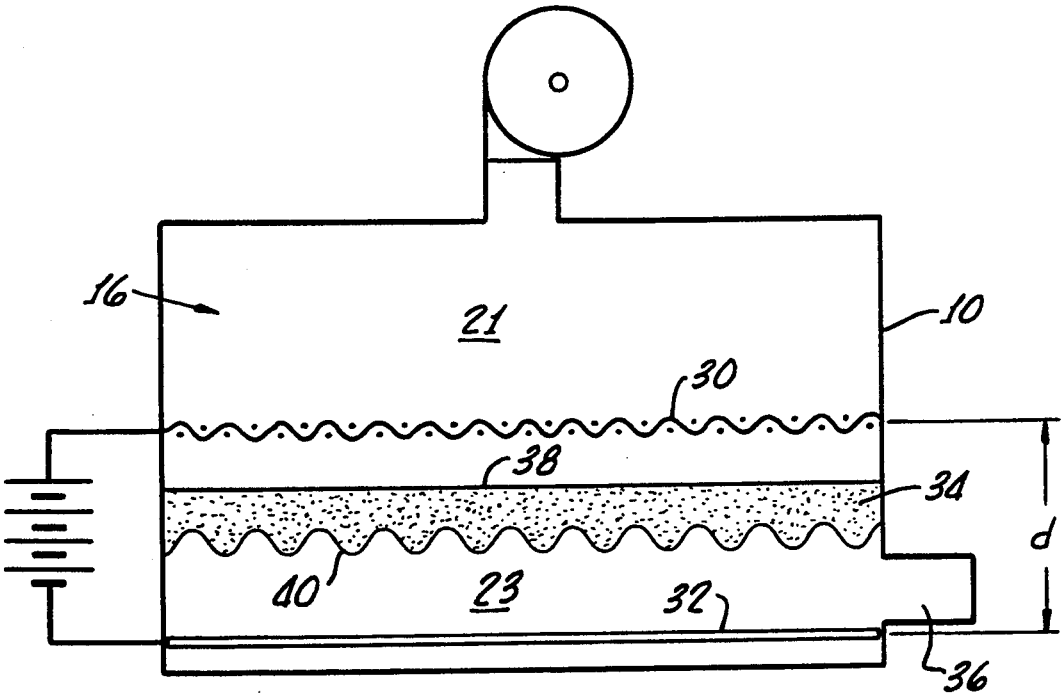
FIG. 3 is a vertical section of a modified embodiment of FIG. 1.

Going now to an,alternative embodiment of the invention, FIG. 3 illustrates two points: first, that the air flow does not have to be drawn through both electrodes, and second, that the filter material does not have to be of uniform thickness.

In FIG. 3, a pair of electrodes 30, 32 in chamber 16 have a filter material 34 disposed between them. Although the electrodes 30, 32 may both be apertured like the electrodes 18, 20 of FIG. 1, the electrode 32 may be solid in the embodiment of FIG. 3 because the air stream exits the chamber 16 through outlet 36 downstream of the filter material 34 but upstream of the electrode 32. (Alternatively, both electrodes may be solid, and the air inlet may be placed in the side of the chamber 16 between electrode 30 and material 34).

A solid electrode 32 produces a slightly more uniform field in the material 34 than a mesh electrode. In either event, however, the electrodes 30, 32 (as well as the electrodes 18, 20) should be substantially smooth and devoid of sharp bends because major surface discontinuities in the electrodes tend to concentrate the field in a non-uniform pattern. However, a uniformly distributed irregularity (such as a surface of knitted metallic mesh) produces a better distribution of the electric field throughout the space between the two electrodes, thus creating better entrapment of particles in the filtering material 24.

The filter material 34 in the embodiment of FIG. 3 is shown as a porous egg-crate type plastic foam material. Although, using the flow rates and size parameters of Example I above, the entry velocity of the air into material 34 along surface 38 at the maximum flow rate would be well above 0.1 m/sec, the internal geometry of the material 34 spreads the air flow so that its velocity at the exit from material 34 along the much larger surface 40 is well below the 0.1 m/sec mark. This is useful to reduce clogging where a wide size range of particles are to be trapped: very large particles would tend to be mechanically trapped near the surface 38, while the entrapment of smaller particles would be distributed through the material 34 with maximum trapping occurring near the surface 40. This action could be enhanced by using a multi-layer filter material with different porosities.

EXAMPLE III

Figure 4:
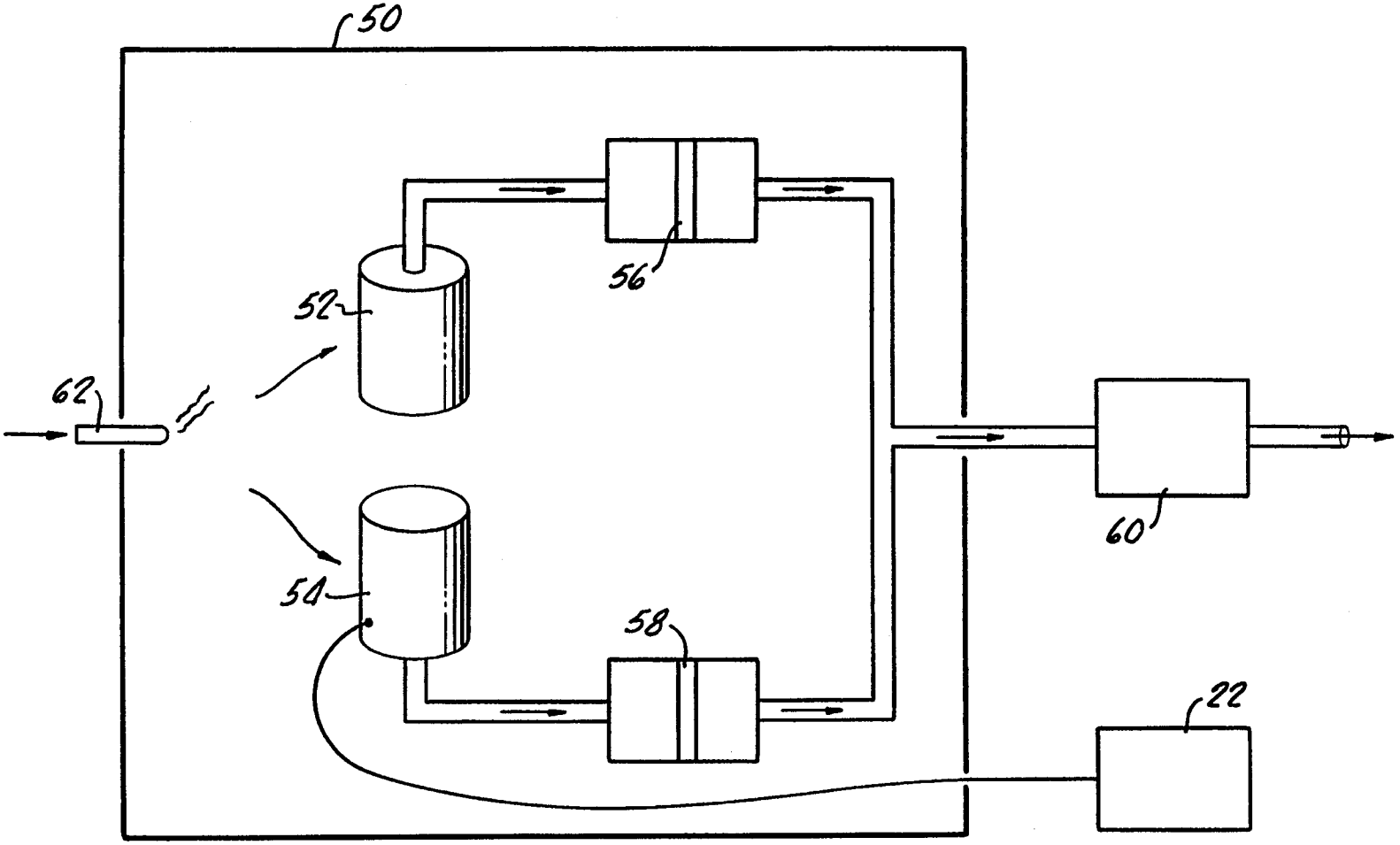
FIG. 4 is a block diagram of an apparatus for testing the invention.

An experimental filtering apparatus was constructed as shown in FIG. 4, using a chamber 50 having a size of 50 cm×31 cm×26 cm. Two identical cylindrical air filters 52, 54 (Purolator Auto Air Filter, model AF 3080) were placed side by side in the chamber 50. Each air filter contained a pleated filter material 24, which was sandwiched between two electrodes spaced 12 mm apart, and formed into a cylindrical structure. For the experiment, the bottom of each air filter was closed and the top was connected to a monitoring membrane 56, 58 which collected the residual smoke particles that had penetrated through the air filter 52 or 54, respectively. The air output is sucked out by a vacuum pump 60 through the membranes 56, 58. The porosity of the air filter material was about 10 microns. Smoke particles from 0.01 to 1 micron in size were drawn from a cigarette. Air was drawn through a burning cigarette 62 (creating smoke) and introduced into the chamber at about1 cfm (472 cubic cms/sec.) rate. The smoke was then separately drawn through the walls of the two identical air filters at an equal rate and exhausted up and out of the cylinders' center through the membranes 56, 58 and out of the chamber.

A voltage of 7 kV was applied across the electrodes of air filter 54. No voltage was applied to air filter 52. The membrane 56 downstream of the air filter 52 displayed a deposit of dark brown material (accumulation of smoke particles). The membrane 58 downstream of air filter 54 showed almost no deposit of particles, almost all particles having been absorbed in the filter material 24 between the electrodes of filter 54.

The efficiency-ratio determined by observing the relative discoloration of the membranes 56, 58 was estimated to be better than 1000 to 1. When,the apparatus was new and clean, air velocity through the filter material 24 of filters 52, 54 was substantially lower than 0.1 m/sec, and when a voltage between 6 kV and 9 kV was applied, even the cigarette odor was not detectable in the air at the output of the filtering apparatus through 54 and 58.

The significance of these findings is that in the absence of an electrostatic voltage, the filter material 24 with a porosity of 10 micron allows almost all particles smaller than 10 micron to pass through the filter material 24. Example III shows that although the porosity of the air filter material is approximately 10 micron in size, when specific conditions of this invention are met (namely (1), the effective output surface area of the filter material placed between the two electrodes is large enough to slow down the air velocity per unit area to a velocity significantly slower than 0.1 m/sec and (2) the voltage on the filter material for enhancing the effect of the Van der Waals force and the particles is 3 kV to 9 kV), practically all particles ranging in size down to 0.01 micron are captured.

EXAMPLE IV

Filter materials with a natural electrostatic charge such as 3M's Filtrete or Toray's Tori-Micron (Japan) have been introduced in the marketplace. Such filters are utilized for supplying clean air to opto-magnetic discs (a recently developed technology used in computer memory systems). These filter materials have also been recently introduced into the home air filtration market.

An experiment was conducted with such a naturally electrostatic material. The following conditions existed: Filter material 24 in the configuration shown in FIG. 1 was tested with and without a 7 kV d.c. voltage across the electrodes 18 and 20; the surface air velocity at the material 24 was 0.01 m/second; the contaminant used was cigarette smoke. The filter material 24 was rated to capture 65% of 0.3 micron particles at 0.016 m/sec air velocity. The experiment showed a better than 1,000% improvement in the filtration by having the 7 kV potential on the electrodes as compared to the filtration obtained with no voltage. There was no notable change by reversing the polarity on the electrodes. At a higher air velocity, 1.0 m/sec., there was still a noticeable difference and improvement in the filtration by applying the 7 kV voltage, but the filtration efficiency was greatly reduced.

The same experiments were conducted with the distance between the electrodes at1 cm and again at 2 cm, and the voltage at 7 kV. There was no noticeable difference in the filtration capability; thus the experiments concluded that enhancement of particle capture by Van der Waals forces in an electric field is not directly related to electric field intensity (expressed by the voltage divided by the distance) but rather by the absolute potential.

EXAMPLE V

Figure 2:
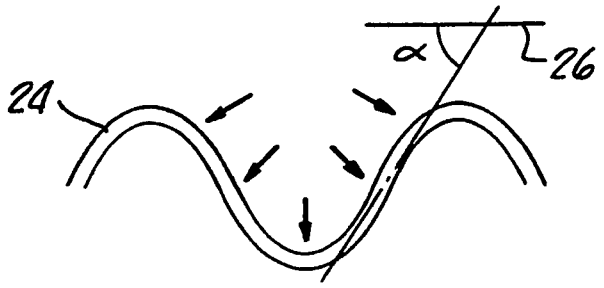
FIG. 2 is a detail section along line 2—2 of FIG. 1.

A 99.9% grade HEPA filter material was tested in a configuration equivalent to FIGS. 1 through 3. Particulates utilized for the air flow were commonly used dioctyl phthalate (DOP) sample contaminants. First the efficiency of HEPA filter material for 0.065–0.3 micron particles was measured with and without the influence of a 6 kV electric field potential at 0.1 m/second surface air velocity. Using those measurement points, the efficiency of the HEPA filter material at 0.01 micron particle size was predicted by a computer extrapolation (there being no readily available measuring instruments on the market for measuring particles smaller than 0.065 $\mu$). The addition of the 6 kV potential resulted in an efficiency increase in the HEPA by one order of magnitude (about 1,000%). Thus it appears that fiberglass HEPA filter material can also be improved with the inventive method by utilizing a combination of Van der Waals forces and particle entrapment between electrodes at a potential of 3,000 volts–9,000 volts, and designing the filter material surface to be such that the air velocity per unit area of the material is sufficiently lower than 0.1 m/sec.

EXAMPLE VI

In this experiment; sixteen layers of cotton sheets (with a total thickness of 2 cm) were placed between the electrodes 18, 20 in the configuration shown in FIG. 1. The air velocity was about 0.03 meters/sec. The particles introduced were from cigarette smoke. The average cotton pore size was estimated to be about 100 microns. The experiment was performed twice. The first-time a voltage of 7 kV was applied across the electrodes with the upstream electrode 18 being positive with respect to the electrode 20. The second time, no voltage was applied. In each instance, after consecutively burning two cigarettes, the cotton layers were separated and examined. Without a potential, a light stain was observed throughout the filter material 24 indicating that the smoke particles passed through the filter but deposited some particles in the filter material during their passage. With a voltage applied, the particles were completely absorbed in the first four layers, with the first layer having the greatest amount of brown stain. The coloring diminished rapidly in the second and third layer; and there was only faint discoloration in the fourth layer.

Another experiment was performed with three layers of a low grade (10% rated) filter material (a total thickness of 3 mm). DOP particle samples were used. The air velocity was 0.1 m/sec. The filter showed 40% capturing efficiency at 0.3 micron particle size without the electric field. With an electric field applied, the capturing efficiency went up to 70% at 6 kV, 93% at 8 kV, and 98.6% at 10 kV.

These experiments of Example VI show the following:

(1) Increasing the thickness of the filter material 24 substantially improves the effectiveness of filtration under a non-ionizing electrostatic field when the attraction of the Van der Waals force between the particles and the surfaces of the filtering material is electrically enhanced,: and the air velocity is low enough (below 0.1 m/sec, but preferably 0.03 m/sec). In this invention, the pore size is far larger than the particle size of interest, and one can design a thicker filter material without creating larger differential pressure across the filter.

(2) The coarseness (porosity) of the filter material 24 can be changed layer by layer (or continuously) to fill the filter material with particles throughout the material thickness by adjusting the porosities. For example, starting with a larger porosity material and gradually progressing to a smaller pore size material helps ensure that the particles are evenly captured and distributed throughout the entire thickness of the material, resulting in a large particle holding capacity.

EXAMPLE VII

A set of experiments were conducted using a system basically represented in FIG. 1. The filter material 24 was placed between the two electrodes 18, 20. A potential of 10 kV was applied to the electrodes 18, 20. A 50% grade filter material was used. The measured capturing efficiency of 56% at 0V increased to 80% at 10 kV when the downstream electrode 20 was negative, and increased to 98% when the downstream electrode 20 was positive.

All conditions being the same, a 10% grade filter material 24 was used. The results showed that the 20% measured capturing efficiency at 0V was increased to 40% when the downstream electrode 20 was negative, and to 90% when the downstream electrode 20 was positive.

Example VII showed that by the inventive technique, a low grade filter material (i.e. material of larger porosity) can achieve almost the same capturing efficiency as a higher grade material. Larger porosity filter materials provide a lower air pressure drop across the surfaces. With a given pressure drop across the filter, a much thicker lower grade material can therefore be adopted, providing better filtration, as the probability of particle impact or contact with the filter fibers increases as the thickness of the filter material increases.

Example VII also showed that as the electrode potential is raised beyond 9 kV, the polarity of the electrode potential becomes increasingly significant, possibly because of incipient ionization effects.

Figure 5A:
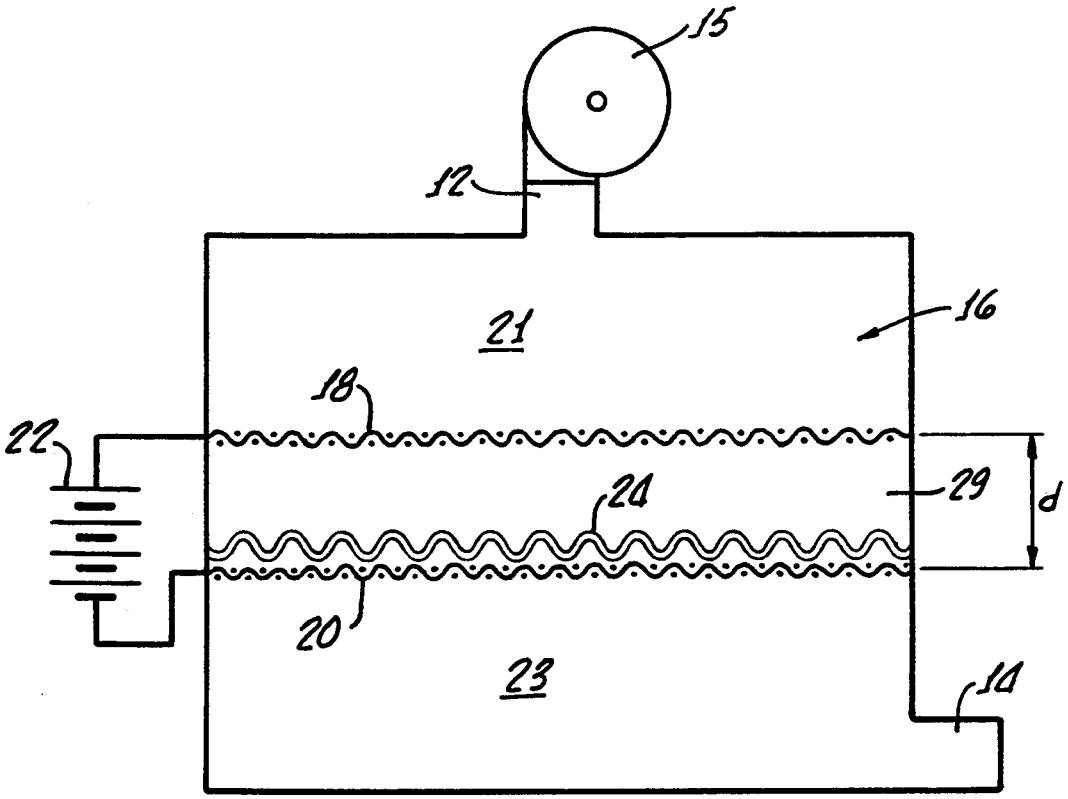
FIG. 5*a* is a vertical section of an alternative embodiment of the invention.
Figure 5B:
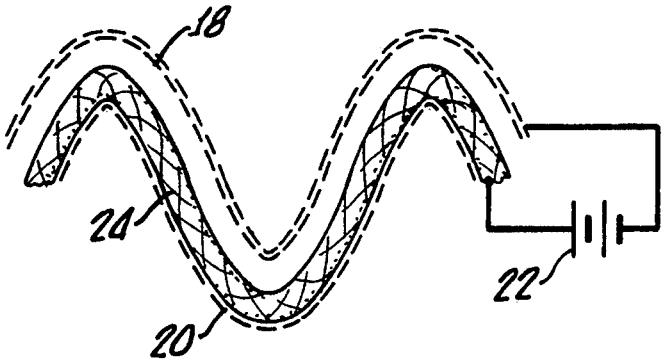
FIG. 5*b* is a detail section of an alternative electrode design.

FIG. 5*a* shows a variation of the structure of FIG. 1 which provides substantially improved filtration. In this embodiment, the filter material 24 is disposed so as to touch the downstream electrode 20, but not the upstream electrode 18. Alternatively, the material 24 may touch the electrode but not the downstream electrode 20.

By choosing the polarity of the source 22 to match the type of the airborne particles (e.g. cigarette smoke, DOP, etc.), better results are obtained. The airgap between the filter material 24, which is in contact with one electrode, and the other electrode significantly improves the filtration and also reduces the current between the electrodes.

EXAMPLE VIII

With the air filter 54 of FIG. 4 being in the general configuration shown in FIG. 1, experiments were performed by having the filter material 24 make contact with the downstream electrode 20 rather than having the filter material 24 suspended in the space between the electrode 18 and 20. A dramatic improvement in filtration occurred.

The filter material used was a 1.2 mm thick HEPA material rated at 50–60 micron porosity and the effective size was 13.3 cm×20.3 cm. The voltage applied was 7 kV. The particles from the cigarette smoke were 0.01 to 1 micron in size. After passing through the filter assembly 54, the uncaptured smoke particles were collected on the membrane 58 and observed by discoloration.

At an air flow rate of about 0.026 m/sec through the filter material 24, two experiments were performed. In the first experiment, a space was left between the filter material 24 and electrode 20; the membrane 58 was completely dark brown. In the second experiment, the filter material 24 was allowed to contact electrode 20; the membrane 58 was almost completely its original white color, demonstrating a much greater efficiency of the filter 54.

The flow rate was increased tenfold and the experiments were repeated. There was still a significant difference between the two experimental results (with or without space between the filter material 24 and electrode 20), although the efficiency of filter 54 was substantially reduced. The polarity between the electrodes 128 and 20 was then reversed. With either polarity, the same results were observed; however, making the downstream electrode 20 positive increased the filter effectiveness slightly.

Similar results were obtained by causing the filter material 24 to contact the upstream electrode 18; however, in this case, an additional mechanical support was required for the filter material 24 (which is normally mechanically weak). Similar results were also obtained by placing the: filter material in the front of the upstream electrode.

EXAMPLE IX

Figure 6:
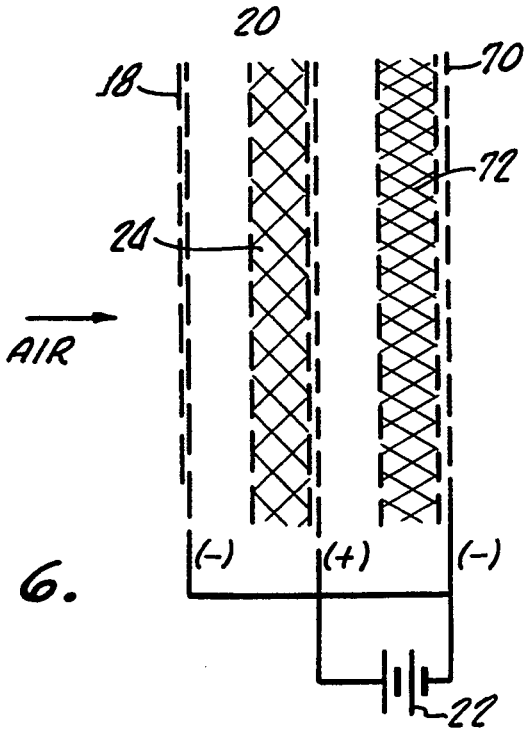
FIG. 6 is a detail section of an alternative filter arrangement.

Another experiment was performed using a system essentially like that of FIG. 4, but using the double-layered filter structure shown in FIG. 6 for both filters 52 and 54. (The structure of FIG. 6 uses three electrodes 18, 20, 70 of alternating polarity, and two layers 24, 72 of filter material, the material 72 being somewhat finer than the material 24.) The potential applied to filter 54 was 8 kV.

The surface velocity was about 0.1 m/sec. A handful of chopped garlic was heated as the source. The output from the filter 52 was intolerable to breathe; on the other hand, the output from the filter 54 was in a very comfortable odor zone, which almost resembled a good smell of cooking.

This experiment concluded that the filter structure of 54 with an electrical potential of 8 kV substantially eliminated the odor and fumes of garlic which have particle sizes ranging from 0.001–1 micron. Knowing the size distributions of fumes, smoke, and DOP particulates, it was concluded that the experimental structure is also adequate for filtering out known bacteria (ranging 0.3–40 microns in size) and viruses (ranging 0.003–0.06 microns in size) from gaseous fluids.

The same experiment was also performed with onion, soy sauce, and food burning in oil for elimination of smoke and odor. Similar excellent results were obtained in minimizing smoke and odor.

EXAMPLE X

In lieu of a conductive filtering material (or filtering material treated or coated with conductive substance) in FIG. 5*a*, a special filter material with sub-micron diameter metallic wires mixed in was used. The wires are chopped and mixed with paper filter material. This filter material with chopped microscopic metal pieces was placed as shown in FIG. 5*a*. The surface air velocity was 0.03 m/sec. Although the metallic pieces in the filter material were not directly in contact with the electrode 20, the induced electric field around each metallic piece significantly enhanced the interaction between the filter material and the Van der Waals force on the particles, resulting in an excellent filtration in comparison with the same filter material without electric potential. This structure of the filter material also minimized needed potential (even below 2000 volts) for creating the required electric field for the subject filtration technique which relies on the Van der Waals force.

The principles of the invention can, of course, be carried out in a variety of configurations.

I claim:

1. Filter apparatus for trapping particles suspended in a gaseous fluid stream, said filter apparatus comprising:

a) filter chamber means for defining an air flow path between an inlet and an outlet;

b) a porous filter positioned in said flow path, said porous filter comprising a dielectric fibrous material having a pore size substantially larger than the average diameter of the particles to be trapped, said filter having a collection surface thereon substantially larger than a cross section of the flow path;

c) impelling means for causing said gaseous fluid stream and particles suspended therein to flow along said flow path and through said porous filter;

d) spaced apart non-ionizing electrode means, positioned in an operative relationship with said porous filter material, for increasing a residence time of the particles in and about said porous filter in order to cause multiple passes of the particles through the filter as the gaseous fluid stream passes through the porous filter for enhancing trapping of said particles by said porous filter, said electrode means being parallel, positioned between said inlet and outlet and having openings therein so as not to significantly affect air flowing therethrough, said electrode means comprising a pair of electrodes positioned in a spaced relationship with the porous filter material therebetween, said air flowing sequentially through one electrode, the porous filter, and then through another of the pair of electrodes; and e) means for applying a selected DC voltage across the electrode means, the DC voltage being selected to prevent ionization of particles passing through the filter, the operation of the filter for trapping particles being dependent more on the selected DC voltage than on the electrode spacing.

2. The filter apparatus of claim 1 wherein said filter material comprises a dielectric fibrous pleated material.

3. The filter apparatus of claim 1, in which said filter material comprises several layers of material with successively smaller porosity in the direction of flow of said fluid stream.

4. The filter apparatus of claim 3 further comprising voltage source means for applying an electric potential across said electrodes within a range of about 2 to about 10 kV.

5. The filter apparatus of claim 3 in which said filter material is substantially 2–3 cm thick in the longitudinal direction of said flow path.

6. The filter apparatus of claim 5 in which said electrodes are substantially parallel to each other, and the distance between them is substantially within the range of 5 mm to 40 mm.

7. The filter apparatus of claim 1, in which said filter material is a material carrying a pre-charged surface charge.

8. The filter apparatus of claim 1, in which said filter material has an average pore size substantially within the range of 0.5 $\mu$m to 10 $\mu$m, and the size of the particles to be trapped is distributed over a range of substantially 0.01 $\mu$m to 1 $\mu$m.

9. The filter apparatus of claim 1, in which the flow velocity of said gaseous fluid stream in said filter material is substantially 0.03 m/sec.

10. The filter apparatus of claim 1, in which said filter material has an entry surface and an exit surface for said gaseous fluid stream, one of said surfaces being substantially greater than the other.

11. The filter apparatus of claim 1 in which said filter material is positioned so as to be in contact with one of said electrodes.

12. The filter apparatus of claim 11, in which said filter material is in contact with the electrode of said electrode pair which is downstream in said fluid path.

13. The filter apparatus of claim 1 in which said filter material is substantially spaced from each of said electrodes.

14. The filter apparatus of claim 13, in which said electrodes are formed of a substantially uniform metallic mesh.

15. The filter apparatus of claim 1, in which said filter material is of substantially uniform thickness and has a surface devoid of sharp discontinuities.

16. The filter apparatus of claim 1, in which said filter material is at least partially conductive.

17. The filter apparatus of claim 16, in which said filter material is a metal-impregnated fibrous material.

18. The filter apparatus of claim 1 wherein said electrode means comprises at least three of said electrodes of alternating potential positioned substantially parallel to each other, and a layer of said filter material is disposed between each pair of said electrodes.

19. Filter apparatus for trapping particles suspended in a gaseous fluid stream, said filter apparatus comprising:

a) filter chamber means for defining an air flow path between an inlet and an outlet;

b) a porous filter positioned in said flow path, said porous filter comprising a dielectric fibrous material having a pore size substantially larger than the average diameter of the particles to be trapped, said filter having a collection surface thereon substantially larger than a cross section of the flow path;

c) impelling means for causing said gaseous fluid stream and particles suspended therein to flow along said flow path and through said porous filter;

d) spaced apart non-ionizing electrode means, positioned in an operative relationship with said porous filter material, for increasing a residence time of the particles in and about said porous filter and cause churning of the particles within the filter as the gaseous fluid stream passes through the porous filter for enhancing trapping of said particles by said porous filter, said electrode means being parallel, positioned between said inlet and outlet and having openings therein so as not to significantly affect air flowing therethrough, said electrode means comprising a pair of electrodes positioned in a spaced relationship with the porous filter material therebetween, Said air flowing sequentially through one electrode, the porous filter, and then through another of the pair of electrodes; and e) means for applying a selected DC voltage across the electrode means, the DC voltage being selected to prevent ionization of particles passing through the filter, the operation of the filter for trapping particles being dependent more on the selected DC voltage than on the electrode spacing.

20. Filter apparatus for trapping particles suspended in a gaseous fluid stream, said filter apparatus comprising:

a) filter chamber means for defining an air flow path between an inlet and an outlet;

b) a porous filter positioned in said flow path, said porous filter comprising a dielectric fibrous material having a natural electrostatic charge and a pore size substantially larger than the average diameter of the particles to be trapped, said filter having a collection surface thereon substantially larger than a cross section of the flow path;

c) impelling means for causing said gaseous fluid stream and particles suspended therein to flow along said flow path and through said porous filter;

d) spaced apart non-ionizing electrode means, positioned in an operative relationship with said porous filter material, for increasing a residence time of the particles in and about said porous filter and cause churning of the particles within the filter as the gaseous fluid stream passes through the porous filter for enhancing trapping of said particles by said porous filter, said electrode means being parallel, positioned between said inlet and outlet and having openings therein so as not to significantly affect air flowing therethrough, said electrode means comprising a pair of electrodes positioned in a spaced relationship with the porous filter material therebetween, said air flowing sequentially through one electrode, the porous filter, and then through another of the pair of electrodes; and e) means for applying a selected DC voltage across the electrode means, the DC voltage being selected to prevent ionization of particles passing through the filter, the operation of the filter for trapping particles being dependent more on the selected DC voltage than on the electrode spacing.

21. Filter apparatus for trapping particles suspended in a gaseous fluid stream, said filter apparatus comprising:

a) filter chamber means for defining an air flow path between an inlet and an outlet;

b) a porous filter positioned in said flow path, said porous filter comprising a dielectric fibrous material having a pore size substantially larger than the average diameter of the particles to be trapped, said filter having a collection surface thereon substantially larger than a cross section of the flow path;

c) impelling means for causing said gaseous fluid stream and particles suspended therein to flow along said flow path and through said porous filter;

d) spaced apart non-ionizing electrode means, positioned in an operative relationship with said porous filter material, for increasing a residence time of the particles in and about said porous filter in order to cause multiple passes of the particles through the filter as the gaseous fluid stream passes through the porous filter for enhancing trapping of said particles by said porous filter due to Van der Waals force, said electrode means being parallel, positioned between said inlet and outlet and having openings therein so as not to significantly affect air flowing therethrough, said electrode means comprising a pair of electrodes positioned in a spaced relationship with the porous filter material therebetween, said air flowing sequentially through one electrode, the porous filter, and then through another of the pair of electrodes; and e) means for applying a selected DC voltage across the electrode means, the DC voltage being selected to prevent ionization of particles passing through the filter, the operation of the filter for trapping particles being dependent more on the selected DC voltage than on the electrode spacing.

* * * * *

UNITED STATES PATENT AND TRADEMARK OFFICE

CERTIFICATE OF CORRECTION

PATENT NO : 5,368,635

DATED : Nov. 29, 1994

INVENTOR(S): Yujiro Yamamoto

It is certified that error appears in the above-identified patent and that said Letters Patent is hereby corrected as shown below:

| Column | Line | |
|---|---|---|
| 2 | 23 | after "material" insert ",". |
| 2 | 23 | after "possible" insert ",". |
| 3 | 61 | delete "occur" and insert therefor - - occurs - -. |
| 12 | 61 | delete "cause" and insert therefor - - causing - - . |
| 13 | 3 | delete "Said" and insert therefor - - said - -. |
| 13 | 31 | delete "cause" and insert therefor - - causing - -. |

Signed and Sealed this

First Day of May, 2001

*Attest:*

*Attesting Officer*

Nicholas P. Godici

NICHOLAS P. GODICI

*Acting Director of the United States Patent and Trademark Office*